United States Patent [19]

Burness et al.

[11] 4,079,014

[45] Mar. 14, 1978

[54] ELECTROGRAPHIC TONER AND DEVELOPER COMPOSITION CONTAINING A 4-AZA-1-AZONIABICYCLO(2.2.2) OCTANE SALT AS A CHARGE CONTROL AGENT

[75] Inventors: Donald MacArthur Burness; Thomas Karl Dykstra; Thomas Arthur Jadwin; Hans Gway Ling, all of Rochester, N.Y.

[73] Assignee: Eastman Kodak Company, Rochester, N.Y.

[21] Appl. No.: 707,457

[22] Filed: Jul. 21, 1976

[51] Int. Cl.[2] ..... G03G 9/08

[52] U.S. Cl. ..... 252/62.1 P; 96/1 SD; 260/268 BF; 427/18

[58] Field of Search ..... 252/62.1 P; 260/268 BF; 96/1 SD; 427/18

[56] References Cited

U.S. PATENT DOCUMENTS

| | | | |
|---|---|---|---|
| 3,577,345 | 5/1971 | Jacknow et al. | 252/62.1 |
| 3,893,935 | 7/1975 | Jadwin et al. | 252/62.1 |

FOREIGN PATENT DOCUMENTS

| | | |
|---|---|---|
| 1,169,703 | 11/1969 | United Kingdom. |
| 1,174,573 | 12/1969 | United Kingdom. |

OTHER PUBLICATIONS

Research Disclosure Bulletin No. 14017, 12–1965.
Bechara et al., U.S. Published Patent Application B. 490,946, 2–17–76.
Anackee et al., C. A. vol. 74, 77658f, (1971).
Miller, C. A., vol. 61, 13330d (1964).

*Primary Examiner*—Mayer Weinblatt
*Assistant Examiner*—John D. Smith
*Attorney, Agent, or Firm*—William T. French

[57] ABSTRACT

The present invention relates to the use of 4-aza-1-azoniabicyclo(2.2.2)octane salts as charge control agents for an electrostatic toner contained in dry electrographic developer compositions. These charge control agents preferably have the formula

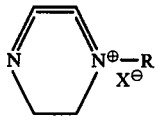

wherein R is an aliphatic organic group having from 4 to about 30 carbon atoms, and X is an anion.

12 Claims, No Drawings

ELECTROGRAPHIC TONER AND DEVELOPER COMPOSITION CONTAINING A 4-AZA-1-AZONIABICYCLO(2.2.2) OCTANE SALT AS A CHARGE CONTROL AGENT

BACKGROUND OF THE INVENTION

This invention relates to electrography and to a particulate toner composition and a dry electrographic developer composition containing such a toner useful in the development of latent electrostatic charge images.

Electrographic imaging and developing processes, e.g. electrophotographic imaging processes and techniques, have been extensively described in both the patent and other literature, for example, U.S. Pat. Nos. 2,221,776 issued Nov. 19, 1940; 2,277,013 issued Mar. 17, 1942; 2,297,691 issued Oct. 6, 1942; 2,357,809 issued Sept. 12, 1944; 2,551,582 issued May 8, 1951; 2,825,814 issued Mar. 4, 1958; 2,833,648 issued May 6, 1958; 3,220,324 issued Nov. 30, 1965; 3,220,831 issued Nov. 30, 1965; 3,220,833 issued Nov. 30, 1965; and many others. Generally these processes have in common the steps of forming a latent electrostatic charge image on an insulating electrographic element. The electrostatic latent image is then rendered visible by a development step in which the charged surface of the electrographic element is brought into contact with a suitable developer mix. Conventional dry developer mixes include toner or marking particles and may also include a carrier vehicle that can be either a magnetic material such as iron filings, powdered iron or iron oxide, or a triboelectrically chargeable, non-magnetic substance like glass beads or crystals of inorganic salts such as sodium or potassium fluoride. The toner or marking particles typically contain a resinous material suitably colored or darkened, for contrast purposes, with a colorant like dyestuffs or pigments such as carbon black.

One method for applying a suitable dry developer mix to a charged image-bearing electrographic element is by the well-known magnetic brush process. Such a process generally utilizes an apparatus of the type described, for example, in U.S. Pat. No. 3,003,462 issued Oct. 10, 1961 and customarily comprises a non-magnetic rotatably mounted cylinder having fixed magnetic means mounted inside. The cylinder is arranged to rotate so that part of the surface is immersed in or otherwise contacted with a supply of developer mix. The granular mass comprising the developer mix is magnetically attracted to the surface of the cylinder. As the developer mix comes within the influence of the field generated by the magnetic means within the cylinder, particles thereof arrange themselves in bristle-like formations resembling a brush. The brush formations that are formed by the developer mix tend to conform to the lines of magnetic flux, standing erect in the vicinity of the poles and laying substantially flat when said mix is outside the environment of the magnetic poles. Within one revolution the continually rotating cylinder picks up developer mix from a supply source and returns part or all of this material to this supply. This mode of operation assures that fresh mix is always available to the surface of the charged electrographic element at its point of contact with the brush. In a typical rotational cycle, the roller performs the successive steps of developer mix pickup, brush formation, brush contact with the electrographic element, e.g. a photoconductive element, brush collapse and finally mix release.

In magnetic brush development, as well as in various other types of electrographic development wherein a dry triboelectric mixture of a particulate carrier vehicle and a toner powder are utilized, e.g., cascade development such as described in U.S. Pat. Nos. 2,638,416 and 2,618,552, it is advantageous to modify the triboelectric properties of the toner powder so that a uniform, stable relatively high net electrical charge may be imparted to the toner powder by the particulate carrier vehicle. It is also highly advantageous if the triboelectric properties of the toner powder remain fairly uniform even when the toner powder is used under widely varying relative humidity (RH) conditions.

A variety of methods and material for modifying the triboelectric properties of particulate toner particles have been proposed. For example, Olson, U.S. Pat. No. 3,647,696 issued Mar. 7, 1972 describes a uniform polarity resin electrostatic toner containing a mono-or difunctional organic acid nigrosine salt. The nigrosine salt described in U.S. Pat. No. 3,647,696 aids in providing a relatively high uniform net electrical charge to a toner powder containing such a nigrosine salt. However, subsequent testing and development relating to the use of such organic acid nigrosine salts has shown that such materials, when incorporated in a toner composition, contribute to a decrease in the adhesion of the toner particles to a suitable paper receiving sheet. For example, it has been found that when a toner image is transferred from a charge image-bearing electrographic element to a paper receiving sheet and fixed to the receiving sheet, the image formed on the receiving sheets tends to flake off when the sheet is bent or folded.

In addition, Greig U.S. Pat. No. 3,079,272, issued Feb. 26, 1963, describes the use of 4–5%, by weight, of anionic compounds, such as stearic acid, in "melt-form" developer compositions containing particulate toner particles to "improve the triboelectric charge relationship" between the toner particles. However, it has been found that fatty acids, such as stearic acid, when incorporated in dry toner formulations of a magnetic brush developer composition do not enable one to obtain a resultant developer in which a relatively high net positive electrical charge is imparted to the toner particles by the magnetic carrier particles. And, it has also been found that incorporation of fatty acids, such as stearic acid, in toner particles tends to decrease adhesion of such toner particles to suitable plain paper receiving sheets.

Other materials which have been employed as modifying agents for dry toner compositions include various long-chain anionic or cationic materials such as various surfactants. Typical of these surfactant materials are the long chain quaternary ammonium surfactants. The use of such materials is described, for example, in British Pat. No. 1,174,573 published Dec. 17, 1969, at page 2, column 2 through page 3. In addition, Jacknow et al U.S. Pat. No. 3,577,345 issued May 4, 1971, describes a solid metal salt of a fatty acid admixed with one of various other described solid additives as a useful modifying combination for a dry toner composition.

Still other materials which have been found useful as charge control agents for electrostatic toner compositions are certain non-surfactant, short-chain, quaternary ammonium salts, such as those described in Jadwin et al U.S. Pat. No. 3,893,935 issued July 8, 1975; quaternary ammonium salt surfactants having an organosulfur-containing anion, such as those described by Jadwin et al in Research Disclosure, No. 14017, published Dec. 1975;

and certain alkoxylated amines, such as those described in Jadwin et al U.S. Pat. No. 3,944,493, issued Mar. 16, 1976. The aforementioned quaternary ammonium salts and alkoxylated amines have been found capable of providing relatively high, uniform net electrical charge to a toner powder in which these materials are incorporated without any substantial deleterious effect on the adhesion properties of the toner compositions.

Although the above-described quaternary ammonium salts have been found quite useful, it would be desirable to have a charge control agent for a dry electrostatic developer composition which imparts even greater RH stability to the developer composition. In addition, it would be useful to find new charge control agents which, when incorporated in toner, provide other advantageous properties, such as a toner which, when admixed with carrier to form a developer, is capable of improved long-life electrographic print uniformity. Also, it would be desirable to find new charge control agents which exhibit higher decomposition temperatures than certain of the preferred charge control agents of the prior art, such as the above-described quaternary ammonium salts and alkoxylated amines.

In addition to the above-mentioned materials which have been used specifically to modify the triboelectric properties of electrostatic toner particles contained in dry electrographic developer compositions, British Pat. No. 1,169,703, dated Nov. 24, 1966, describes the use of relatively large amounts, i.e., from 2 to about 15 percent by weight, of various ammonium salts, including myristyl dimethyl ammonium ethyl sulphate and cetyl dimethyl ethyl ammonium ethyl sulphate as additives for conducting printing ink particles to increase the electrical conductivity thereof to a level generally less than $10^{10}$ ohm-cm.

SUMMARY OF THE INVENTION

In accordance with the present invention there is provided an improved dry particulate electrostatic toner composition and a dry developer composition containing said toner triboelectrically attractable to a particulate carrier vehicle. The improved toner composition of the invention comprises a polymeric binder and, dispersed in said binder as a charge control agent, a 4-aza-1-azoniabicyclo(2.2.2) octane salt. Advantageously, a suitable colorant such as a pigment or dye may also be incorporated in the toner.

In accordance with one advantageous embodiment of the invention, it has been found that charge control agents particularly useful in the present invention are materials having the following formula:

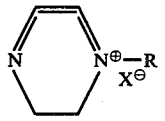

wherein R represents an aliphatic organic group containing 4 to about 30 carbon atoms, and X is an anion.

DESCRIPTION OF THE PREFERRED EMBODIMENTS

The present invention has been found to provide numerous advantages. Among others, the 4-aza-1-azoniabicyclo(2.2.2) octane salts used as charge agents in the invention provide a dry, particulate toner composition which exhibits a relatively high, uniform and stable net toner charge when admixed with a suitable particulate carrier vehicle.

It has also been found that the charge agents of the present invention have relatively high decomposition temperatures. This high decomposition temperature eliminates degradation problems during compounding of the charge agent into the toner. Such degradation problems can be experienced when using other useful prior art charge agents such as, for example, the tetrapentylammonium chloride described in U.S. Pat. No. 3,895,935.

As indicated above, typical representative charge agents of the present invention include those having the formula:

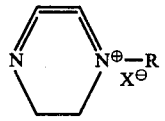

wherein R is an aliphatic organic group containing 4 to about 30 carbon atoms and X is an anion.

Useful such aliphatic organic groups include both substituted and unsubstituted alkyl groups and alkenyl groups. Typical examples of substituents in such groups include ester, carboxyl, hydroxyl, ether, sulfone, amide groups, and the like. In a preferred embodiment of this invention, R is an unsubstituted alkyl group.

The polymers useful as binders in the practice of the present invention include those polymers and resins conventionally employed in electrostatic toners. Useful polymers generally have a glass transition temperature within the range of from 40° to 120° C. Preferably, toner particles prepared from these polymeric materials have relatively high caking temperature, for example, higher than about 55° C., so that the toner powders may be stored for relatively long periods of time at fairly high temperatures without having individual particles agglomerate and clump together. The softening temperature of useful polymers preferably is within the range of from about 40° C. to about 200° C. so that the toner particles can readily be fused to conventional paper receiving sheet to form a permanent image. Especially preferred polymers are those having a softening temperature within the range of from about 40° C. to about 65° C. because toners containing these binders can be used in high speed electrographic copy machines employing plain paper as the receiving sheet to which the toned images are fused. Of course, where other types of receiving elements are used, for example, metal plates such as certain printing plates, polymers having a softening temperature and glass transition temperature higher than the values specified above may be used.

As used herein the term "softening temperature" refers to the softening temperature of a polymer as measured by E. I. duPont de Nemours Company, Model 941 TMA (Thermal Mechanical Analyzer). Glass transition temperature (Tg) as used herein refers to the temperature at which a polymeric material changes from a glassy polymer to a rubbery polymer. This temperature (Tg) can be measured by differential thermal analysis as disclosed in Techniques and Methods of Polymer Evaluation, Vol. 1, Marcel Dekker, Inc., N.Y. 1966.

Among the various polymers which may be employed in the toner particles of the present invention are styrene-containing resins, polycarbonates, rosin modified maleic alkyd resins, polyamides, phenol-formaldehyde resins and various derivatives thereof, polyester condensates, modified alkyd resins and the like, aromatic resins containing alternating methylene and aromatic units such as described in Merrill et al, U.S. Pat. No. 3,809,554, issued May 7, 1974, and fusible cross-linked polymers as described in Jadwin et al, U.S. Pat. No. 3,938,992, issued Feb. 17, 1976, and the like.

Especially useful toner polymers include certain polycarbonates such as those described in U.S. Pat. No. 3,694,359 issued Sept. 26, 1972, and which includes polycarbonate materials containing an alkylidene diarylene moiety in a recurring unit and having from 1 to about 10 carbon atoms in the alkyl moiety. Other useful polymers having the above-described physical properties include polymeric esters of acrylic and methacrylic acid such as poly(alkylacrylate) including poly(alkylmethacrylate) wherein the alkyl moiety can contain from 1 to about 10 carbon atoms. Additionally, other polyesters having the aforementioned physical properties are also useful.

Still other especially useful toner polymers are various styrene-containing resins. Such polymers typically comprise a polymerized blend of from about 40 to about 100 percent by weight of styrene, including styrene homologs; from about 0 to about 45 percent by weight of one or more lower alkyl acrylates or methacrylates having from 1 to about 4 carbon atoms in the alkyl moiety such as methyl, ethyl, isopropyl, butyl, etc.; and from about 0 to about 50 percent by weight of one or more vinyl monomers other than styrene, for example, a higher alkyl acrylate or methacrylate (including branched alkyl and cycloalkyl acrylates and methacrylates) having from about 6 to 20 or more carbon atoms in the alkyl group. A typical styrene-containing polymer prepared from a copolymerized blend as described hereinabove are copolymers prepared from a monomeric blend of 40 to 60 percent by weight styrene or styrene homolog, from about 20 to about 50 percent by weight of a lower alkyl acrylate or methacrylate and from about 5 to about 30 percent by weight of a higher alkyl acrylate or methacrylate such as ethylhexyl acrylate. Especially useful styrene-containing binder resins are cross-linked fusible styrene-containing polymers such as described in the above-referenced Jadwin et. al. patent application. A variety of other useful styrene containing toner materials are disclosed in the following U.S. Pat. Nos. 2,917,460 issued Dec. 15, 1959; Re. 25,136 issued Mar. 13, 1962; 2,788,288 issued Apr. 9, 1957; 2,638,416 issued Apr. 12, 1953; 2,618,552 issued Nov. 18, 1952 and 2,659,670 issued Nov. 17, 1953.

The amount of binder polymer employed in the toner particles used in the present invention may vary depending on the amounts of other addenda which one may desire to incorporate in the toner composition. For example, various colorant and/or magnetic materials can advantageously be incorporated in the toner particles when the particles are desired for use in certain applications requiring such addenda. Typically, however, the binder polymer is present in an amount equal to or greater than about 50 percent by weight of the toner composition. And, in accord with certain particularly useful embodiments of the invention where it is desired to employ the resultant toner composition in a high speed electrographic office copy machine, it is desirable to use an amount of binder polymer within the range from about 75 to about 98 weight percent based on the total weight of the particulate toner composition.

The toner particles of the present invention can be prepared by various methods. One convenient technique for preparing these toners is spray-drying. Spray-drying involves dissolving the binder polymer and adding the toner colorant and charge control agent to a volatile organic solvent such as dichloromethane. This solution is then sprayed through an atomizing nozzle using a substantially nonreactive gas such as nitrogen as the atomizing agent. During atomization, the volatile solvent evaporates from the airborne droplets, producing toner particles of the uniformly dyed or pigmented resin. The ultimate particle size is determined by varying the size of the atomizing nozzle and the pressure of the gaseous atomizing agent. Typically, these particles have a diameter between about 0.1 micron and about 100 microns; although, in general, present day office copy devices typically employ particles between about 1.0 and 30 microns and desirably between about 2.0 and 15 microns. However, larger particles or smaller particles can be used where desired for particular methods of development or particular development conditions. For example, in powder cloud development such as described in U.S. Pat. No. 2,691,345 issued Oct. 12, 1954, extremely small toner particles on the order of about 0.01 microns may be used.

Another convenient method for preparing the toner composition of the present invention is melt-blending. This technique involves melting a powdered form of toner polymer or resin and mixing it with suitable colorants, such as dyes or pigments, and the charge control agent. The polymer can readily be melted on heated compounding rolls which are also useful to stir or otherwise blend the polymer and addenda so as to promote the complete intermixing of these various ingredients. After thorough blending, the mixture is cooled and solidified. The resultant solid mass is then broken into small particles and finely ground to form a free-flowing powder of toner particles. These particles also typically have an average particle size or average diameter within the range of from about 0.1 to about 100 microns.

As described hereinabove the charge control agents used in the invention are added to the polymeric toner composition in an amount effective to improve the charge properties of the toner composition. The addition of a charge control agent improves the charge uniformity of a particular toner composition, i.e. acts to provide a toner composition in which all or substantially all of the individual discrete toner particles exhibit a triboelectric charge of the same sign (negative or positive) with respect to a given carrier vehicle, increases the net electrical charge exhibited by a specified quantity of toner particles relative to a given carrier vehicle. As used herein, the phrases "net electrical charge exhibited by a toner powder" or "net toner charge" are equivalent and are defined as the total electrical charge exhibited by a specified amount of a particular toner when admixed with a specified amount of a particular carrier vehicle. Although the phenomenon by which such an electrical charge is imparted is not fully understood, it is believed due in large part to the triboelectric effect caused by the physical admixture of toner and carrier.

The amount of the charge control agent useful in the present invention is important. Generally, it has been found desirable to employ an amount of charge control agent within the range of from about 0.001 to about 3 weight percent and preferably 0.1 to about 2.0 weight percent based on the total weight of the particulate toner composition. If amounts much lower than those specified above are used, the charge control agent tends to exhibit little or substantially no improvement in the properties of the toner composition. Of course, it must be recognized that the optimum amount of charge control agent to be added will depend in part on the particular toner composition to which it is added. However, the amounts specified hereinabove are typical of the useful range of charge control agent of the present invention which can be effectively used in conventional dry toner materials.

As indicated, the control agents employed in the present invention are 4-aza-1-azoniabicyclo(2.2.2) octane salts. In accord with one useful embodiment of the invention, the charge agents of the invention tend to provide particularly useful results when the concentration of the charge agent within an individual toner particle is greater at or near the surface of the particle than it is within the interior of the particle. Of course, useful results can also be obtained in accord with the present invention when the charge agents described herein are distributed in a uniform manner throughout the toner particle composition.

A variety of colorant materials selected from dyestuffs or pigments may be employed in the toner materials of the present invention. Such materials serve to color the toner and/or render it more visible. Of course, suitable toner materials having the appropriate charging characteristics can be prepared without the use of a colorant material where it is desired to have a developed image of low optical opacity. In those instances where it is desired to utilize a colorant, the colorants used, can, in principle, be selected from virtually any of the compounds mentioned in the Colour Index, Volumes 1 and 2, Second Edition.

Included among the vast number of useful colorants would be such materials as Hansa Yellow G (C.I. 11680), Nigrosine Spirit soluble (C.I. 50415), Chromogen Black ETOO (C.I. 45170), Solvent Black 3 (C.I. 26150), Fuchsine N (C.I. 42510), C.I. Basic Blue 9 (C.I. 52015), etc. Carbon black also provides a useful colorant. The amount of colorant added may vary over a wide range, for example, from about 1 to about 20 percent of the weight of the polymeric binder. Particularly good results are obtained when the amount is from about 2 to about 10 percent. In certain instances, it may be desirable to omit the colorant, in which case the lower limit of concentration would be zero.

Where the toner contains a black colorant, samll amounts of color-balancing dyes can also be dissolved in the resin binder if desired for the production of a neutral black color. Conventionally, such color-balancing dyes are included in amounts less than about 1.5 percent of the toner's total weight, although greater amounts can be used if desired as long as the triboelectric properties of the toners are preserved.

The toners of this invention can be mixed with a carrier vehicle to form developing compositions. The carrier vehicles which can be used with the present toners to form new developer compositions can be selected from a variety of materials. Suitable carrier vehicles useful in the invention include various nonmagnetic particles such as glass beads, crystals of inorganic salts such as sodium or potassium chloride, hard resin particles, metal particles, etc.

In addition, magnetic carrier particles can be used in accordance with the invention. In fact, the toner compositions of the present invention are especially suited for use with magnetic carrier particles as the problem of "toner throw-off" is especially bothersome in magnetic brush development processes. Suitable magnetic carrier particles are particles of ferromagnetic materials such as iron, cobalt, nickel, and alloys and mixtures thereof. Other useful magnetic carriers are mixtures of rough-surfaced, irregularly shaped magnetic particles and smooth-surfaced, regularly-shaped magnetic particles such as described in Trachtenberg et al, U.S. Pat. No. 3,838,054, issued Sept. 24, 1974. Other useful magnetic carriers are particles wherein each individual carrier particle contains a plurality of magnetic particles uniformly dispersed throughout an electrically insulating polymeric matrix such as described in Canadian Patent 835,317 dated Feb. 24, 1970. Other useful magnetic carriers are ferromagnetic particles overcoated with a thin layer of various film-forming resins, for example, the alkali-soluble carboxylated polymers described in Miller, U.S. Pat. No. 3,547,822 issued Dec. 15, 1970. Still other useful resin coated magnetic carrier particles are described in Miller, U.S. Pat. No. 3,632,512 issued Jan. 4, 1972; McCabe, U.S. Pat. No. 3,795,617, issued Mar. 5, 1974, entitled "Electrographic Carrier Vehicle and Developer Composition — Case B"; and Kasper U.S. Pat. No. 3,795,618, issued Mar. 5, 1974, entitled, "Electrographic Carrier Vehicle and Developer Composition — Case D". Other useful resin coated magnetic carrier particles include carrier particles coated with various fluorocarbons such as polytetrafluoroethylene, polyvinylidene fluoride, and mixtures thereof including copolymers of vinylidene fluoride and tetrafluoroethylene.

A typical developer composition containing the above-described toner and a carrier vehicle generally comprises from about 1 to about 10 percent by weight of particulate toner particles. Typically, the carrier particles are larger than the toner particles. Conventional carrier particles have a particle size on the order of from about 30 to about 1200 microns, preferably 60–300 microns.

The toner and developer compositions of this invention can be used in a variety of ways to develop electrostatic charge patterns or latent images. Such developable charge patterns can be prepared by a number of means and be carried for example, on a light sensitive photoconductive element or a non-light sensitive dielectric-surfaced element such as a receiver sheet. One suitable development technique involves cascading the developer composition across the electrostatic charge pattern; while another technique involves applying toner particles from a magnetic brush. This latter technique involves the use of a magnetically attractable carrier vehicle in forming the developer composition. After imagewise deposition of the toner particles, the image can be fixed by heating the toner to cause it to fuse to the substrate carrying the toner. If desired, the unfixed image can be transferred to another support such as a blank sheet of copy paper and then fixed to form a permanent image.

The following examples are included for a further understanding of the invention.

EXAMPLE 1

In this example a control toner containing no charge control agent was prepared having the following components by weight:

100 parts — poly(styrene-co-methyl methacrylate-co-ethylhexyl methacrylate)-polymeric binder 5 parts — Regal 300 R® carbon black purchased from Cabot Corp. — colorant The toner was prepared by melt blending the addenda on a two-roll mill, cooling the material, and then grinding in a fluid energy mill to an average size of between 3 to 15 microns.

The toner was employed in a developer composition containing 3 weight percent toner and 97 weight percent of carrier particles composed of Hoeganaes EH sponge iron particles (having a size range from about 85 microns to about 150 microns) partially coated with a fluorocarbon resin at 0.16 parts by weight resin per 100 parts carrier particles. The effective charge (μcoul/gram) of this developer was measured and found to be −3.6 μcoul/gram (Table I). The desired triboelectric range is 8–35 μcoul/gram. Therefore, this developer charged too low and to the wrong polarity.

EXAMPLES 2–17

Examples 2–17 demonstrate the triboelectric effectiveness of various 1-alkyl-4-aza-1-azoniabicyclo(2.2.2) octane salts.

Synthesis

The monoalkylation of diamines is accomplished by reaction of an alkyl halide, or a sulfonic ester, with an excess (20%) of diamine in a suitable organic solvent. For the more reactive bromides and iodides, anhydrous ether usually is the solvent of choice. As for the less reactive chlorides and mesylates, acetonitrile at elevated temperatures is needed for the reaction to take place. Ion exchange from the corresponding halides provides other anionic species, e.g., nitrate, methosulfate and fluoroborate.

By way of illustration, to prepare 1-hexadecyl-4-aza-1-azoniabicyclo(2.2.2)octane chloride (Example 14), a stirred mixture of 1-chlorohexadecane (52.2 g) and triethylenediamine (26.9 g) in 400 ml dry acetonitrile was refluxed for about 16 hours. The reaction mixture was then cooled to 0° C, filtered in a dry box, washed with cold acetonitrile and ether, and dried in a vacuum desiccator over $P_2O_5$. Yield was 68.0 grams (91%).

Toner Preparation

The following composition was used for Examples 2–18.

100 parts — poly(styrene-co-methyl methacrylate-co-ethylhexyl methacrylate)

0.5 parts — 1-alkyl-4-aza-1-azoniabicyclo(2.2.2)-octane salt — charge control agent 5 parts — Regal 300R® carbon black The toners were prepared in a manner similar to Example 1 and tested on the carrier of Example 1 at 3 percent concentration. The results are given in Table I. It may be noted from Table I that the addition of these charge agents changed the polarity of charge from negative to positive. Except for Example 2, where R contains two carbon atoms, the charge is in a useful range of 8–35 μcoul/gram.

Table I

Use of 1-Alkyl-4-azo-1-azoniabicyclo-(2.2.2)octane Salts as Charge Control Agents

| Example | Alkyl Group having the following Carbon$^R$ Chain Length | $X^-$ | Triboelectric Charge (μcoul/gram) |
|---|---|---|---|
| 1* | — | — | −3.6 (control) |
| 2 | 2 | $Cl^-$ | 4.6 |
| 3 | 4 | $Cl^-$ | 23.7 |
| 4 | 6 | $Cl^-$ | 19.9 |
| 5 | 8 | $Br^-$ | 12.3 |
| 6 | 10 | $Cl^-$ | 14.0 |
| 7 | 10 | $I^-$ | 9.3 |
| 8 | 12 | $Cl^-$ | 10.0 |
| 9 | 12 | $Br^-$ | 13.1 |
| 10 | 12 | $NO_3^-$ | 14.0 |
| 11 | 12 | $CH_3OSO_3^-$ | 22.9 |
| 12 | 12 | $CH_3SO_3^-$ | 21.6 |
| 13 | 14 | $Br^-$ | 15.2 |
| 14 | 14 | $Cl^-$ | 9.3 |
| 15 | 16 | $Cl^-$ | 20.8 |
| 16 | 16 | $Br^-$ | 26.3 |
| 17 | 16 | $BF_4^-$ | 10.0 |
| 18 | 18 | $Br^-$ | 18.7 |

*No charge control agent used.

EXAMPLE 19

The thermal decomposition temperature of two charge agents described in this invention were compared with tetrapentylammonium chloride, a highly useful charge agent of the type described in U.S. Pat. No. 3,893,935. The results are given in Table II.

Table II

| Charge Agent | Decomposition Temperature (° C) |
|---|---|
| 1-hexadecyl-4-aza-1-azoniabicyclo-(2.2.2)octane chloride | 225 |
| 1-hexadecyl-4-aza-1-azoniabicyclo-(2.2.2)octane bromide | 247 |
| tetrapentylammonium chloride | 181 |

Table II shows that certain of the charge agents described in this invention have a higher decomposition temperature than tetrapentylammonium chloride. This higher decomposition temperature eliminates degradation problems during compounding of the charge agent into the toner. It also permits the use of continuous compounding operations such as twin screw extruders.

The invention has been described in detail with particular reference to certain preferred embodiments thereof, but it will be understood that variations and modifications can be effected within the spirit and scope of the invention.

We claim:

1. A dry, particulate electrostatic toner containing particles having a particle size of from about 0.1 micron to about 100 microns, said particles having a composition comprising a polymeric binder having a softening temperature within the range of from about 40° C to about 200° C and a material having the formula:

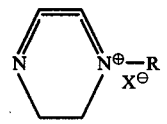

wherein

R is an aliphatic organic group having from 4 to about 30 carbon atoms, and

X is an anion.

2. A dry, particulate electrostatic toner as defined in claim 1 wherein said particle contains a pigment or a dyestuff in an amount effective to color said particles.

3. A dry, particulate electrostatic toner as defined in claim 1 wherein said material is present in a concentration within the range of from about 0.001 to about 3 weight percent.

4. A dry, particulate electrostatic toner containing particles having a particle size of from about 0.1 micron to about 30 microns, said particles having a composition comprising (a) a polymeric binder having a softening temperature within the range of from about 40° C to about 200° C, (b) a pigment or dyestuff in an amount effective to color said particles, and (c) a material having the following formula:

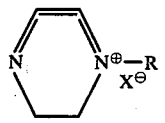

wherein

R is an aliphatic organic group having from 4 to about 30 carbon atoms, and

X is an anion.

5. A dry, particulate electrostatic toner as defined in claim 4 wherein said polymeric binder is a styrene-containing binder.

6. A dry, particulate electrostatic toner as defined in claim 4 wherein said material is present in a concentration within the range of from about 0.001 to about 3 weight percent.

7. A dry, particulate electrostatic toner containing particles having a particle size of from about 0.1 micron to about 30 microns, said particles having a composition comprising (a) a styrene-containing polymeric binder, (b) a pigment or dyestuff in an amount effective to color said particles, and (c) an amount within the range of from about 0.001 to about 3 percent by weight of said particles of a material having the following formula:

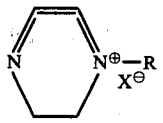

wherein

R is an aliphatic organic group having from 4 to about 30 carbon atoms, and

X is an anion.

8. A dry, particulate electrostatic toner as defined in claim 7 wherein said particles contain carbon black as a pigment.

9. A dry, particulate electrostatic toner as defined in claim 7 wherein said material is present in a concentration within the range of from about 0.1 to about 2 weight percent.

10. An electrographic developer composition comprising magnetic carrier particles having a particle size within the range of from about 30 to about 1200 microns and having electrostatically attractable thereto a dry, particulate electrostatic toner containing particles having a particle size of from about 0.1 micron to about 30 microns, said toner particles having a particle composition comprising (a) a polymeric binder having a softening temperature within the range of from about 40° C to about 200° C, (b) a pigment or dyestuff in an amount effective to color said toner particles, and (c) a material having the following formula:

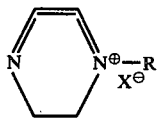

wherein

R is an aliphatic organic group having from 4 to about 30 carbon atoms, and

X is an anion.

11. An electrographic developer composition as defined in claim 10 wherein said material is present in a concentration within the range of from about 0.001 to about 3 percent by weight of said toner particles.

12. An electrographic developer composition as defined in claim 10 wherein said polymeric binder is a styrene-containing binder.

* * * * *